United States Patent [19]

Worback

[11] 4,085,855

[45] * Apr. 25, 1978

[54] MECHANISM CONTROL

[75] Inventor: David L. Worback, Highland, Mich.

[73] Assignee: Massey-Ferguson Inc., Detroit, Mich.

[ * ] Notice: The portion of the term of this patent subsequent to Feb. 15, 1994, has been disclaimed.

[21] Appl. No.: 746,572

[22] Filed: Dec. 1, 1976

Related U.S. Application Data

[63] Continuation-in-part of Ser. No. 654,675, Feb. 2, 1976, which is a continuation-in-part of Ser. No. 559,271, Mar. 17, 1975, Pat. No. 4,007,845.

[51] Int. Cl.[2] ..... E02F 3/32

[52] U.S. Cl. ..... 214/138 D; 91/420

[58] Field of Search ..... 214/138 D, 138 R; 91/412, 420, 454, 183, 186

[56] References Cited

U.S. PATENT DOCUMENTS

| | | | |
|---|---|---|---|
| 3,795,178 | 3/1974 | Roche | 91/420 |
| 3,922,855 | 12/1975 | Bridwell et al. | 214/138 R |
| 4,007,845 | 2/1977 | Worback | 214/138 D |

*Primary Examiner*—Drayton E. Hoffman
*Assistant Examiner*—Ross Weaver
*Attorney, Agent, or Firm*—Thomas P. Lewandowski

[57] ABSTRACT

Control for a swing mechanism having linear actuators such as hydraulic cylinders connected to the swing mechanism in a manner whereby the actuators work in unison with each other over a portion of the swing of the swing mechanism and in opposition to each other over another portion of the swing when imparting arcuate motion to the swing mechanism with the linear motion of the actuators. The control includes a pressure reducing-metering valve and a metering valve in each of two sets of lines which supply and return pressurized fluid to the actuators. The improvement comprises location of check valves and pilot lines to enhance anti-cavitation conditions by reducing the number of flow paths.

3 Claims, 1 Drawing Figure

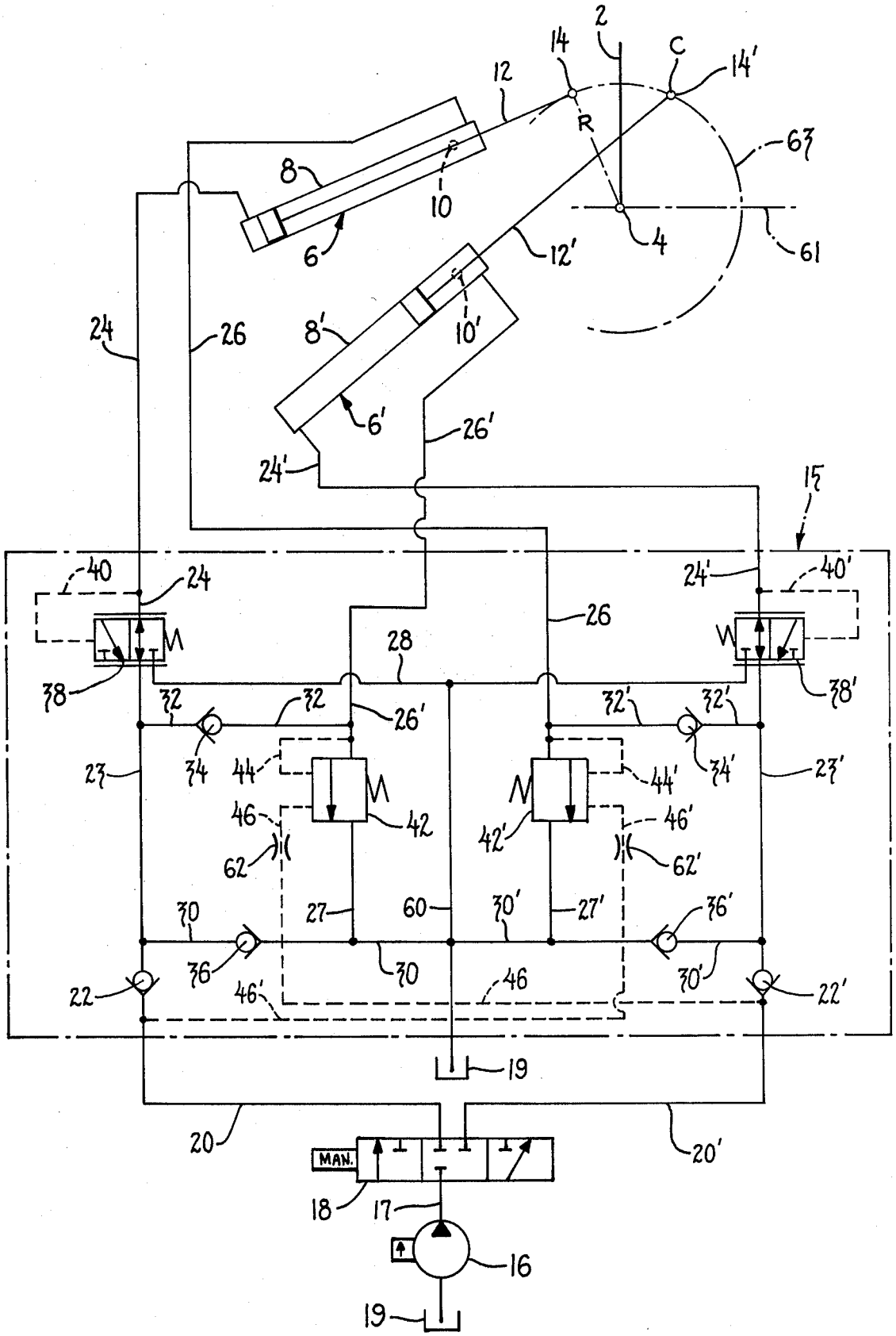
2
14
C
14'
12
R
63
8
10
6
4
61
12'
8'
10'
24
26
6'
26'
24'
15
40
24
24'
40'
26
28
38
38'
32
32
26'
32'
32'
23
34
44
34'
23'
44'
46
42
42'
46'
62
62'
30
27
60
30'
27'
36'
36
30
30'
22
46'
46
22'
19
20
20'
MAN.
18
17
16
19

MECHANISM CONTROL

This is a continuation-in-part of application Ser. No. 654,675 filed Feb. 2, 1976 which is a continuation-in-part of application Ser. No. 559,271 filed Mar. 17, 1975 now issued as U.S. Pat. No. 4007,845 and incorporates as a part hereof the subject matter disclosed therein.

The applications disclose an invention relating generally to a swing mechanism and more particularly to a backhoe and apparatus for controlling the side to side swinging movement of a backhoe boom or like type machine.

The above noted parent patent applications disclose the geometry of the present system which includes a pair of linear cylinders as actuators for swinging a member such as a backhoe boom mounted on a swing unit in such manner that the boom can be actuated by an operator to swing from side to side to position the boom at a desired location in a horizontal path for digging purposes. As pointed out in the disclosure, it control circuit is a simplification over the complex circuitry of presently manufactured equipment for control of swinging movement.

In the present invention a way of plumbing the controls has been devised to further improve its circuit over the above noted parent applications. The first application took the general approach of isolating each valve in the circuit from all the other valves. Use of a combination valve in the second application eliminated one of the valves of the first application requiring a change in plumbing.

It was found that the plumbing of the second application resulted in three paths of flow being available for returning fluid flow from the cylinders used as power means for the swing mechanism disclosed. One of the paths was across a directional valve which was a two-way valve. A second path was through a cross line extending between supply and return lines which cross line was connected to sump. The third path was through the supply line across the combination valve to the cylinder to prevent anti-cavitation for conditions such as when a cylinder was in overcenter position, i.e. in a pumping mode.

The third path is preferred whenever fluid is required by a cylinder, but the plumbing would allow a random choice to be made. Further, the first path required a two way directional valve.

The present system improves on the above system with plumbing which allows use of a single acting, one way, directional valve by eliminating the first path and makes the third path preferred over the second path by virtue of less resistance in the third path over the second path. The above improvement resulted from a relocation of the check valve from a position between the cross line and the combination valve to a position between the cross line and the directional valve.

The present invention includes a power source such as a pump to supply pressurized fluid to power means such as hydraulic cylinders connected to a swing member, for example a backhoe swing casting, swingable in opposite directions in response to flow of hydraulic fluid in opposite directions to and from the power means. At least one pair of hydraulic lines conduct the fluid to and from the power means. Flow of fluid to the power means in one of the lines causes the swing member to swing in one direction and flow in the other line causes swinging in the other direction. A pressure reducing metering valve in the one line limits pressure to the power means through the one line to a predetermined maximum pressure when the swing member moves in one direction, and meters fluid from the power means upon overriding of the movement of the swing member in the other direction above a predetermined maximum pressure. A metering valve is operable to permit flow of fluid from the power means through the other line during the swinging movement of the swing member only when a predetermined minimum pressure exists in the one line or a predetermined maximum pressure exits in the other line.

The one line includes as a portion thereof a supply line which contains the pressure reducing metering valve and a main line connected with the supply line. A cross line bridges the supply lines for each cylinder of the swing mechanism. A check valve is located in the one line between the cross line and the directional valve permitting flow to a head end of the power means through the main line, but preventing flow from the head end of the power means through the main line.

The above advantages of the invention will become readily apparent to one skilled in the art from reading the following detailed description of an embodiment of the invention when considered in light of the accompanying drawing in which:

FIG. 1 is a schematic of a system and controls incorporating an embodiment of the present invention.

Referring to FIG. 1 a hydraulic system indicated collectively by reference numeral 15 is illustrated with common reference numerals identifying common components to those of FIG. 2 and FIG. 1 respectively of the first and second parent applications unless otherwise identified.

The geometry of the power means 6, 6′ and swing bracket 2 of FIG. 1 of the first parent application is the same for the present application and, therefore, FIG. 1 of the first parent application is not repeated herein. The first five pages of the first parent application fully describe the purpose of the particular embodiment disclosed in FIG. 1 thereof. On pages 10–13 and 14–15 of the first parent application the function of the above geometry is disclosed and not repeated here.

Returning to FIG. 1 of the present application, the supportive components to the hydraulic system disclosed, such as the pump 16 and sump 19 etc., are also as disclosed in the parent applications. One exception has already been noted and that is that the directional valve 18 is now a single acting valve. Turning to the circuit disclosed, main line 20 is connected via a check valve 22 with one end of a supply line 23, the other end of line 23 being connected with a head end line 24 to the head end of actuator 6. Note that check valve 22 has been relocated over the position in the supply line in FIG. 1 of the second parent application which change will be taken up below. The rod end of actuator 6 is connected with a rod end line 26. Similarly, main line 20′ is connected via a check valve 22′ with supply line 23′ and a head end line 24′ to the head end of actuator 6′, the rod end of actuator 6′ being connected with a rod end line 26′. Check valve 22′ has been relocated in the same manner as check valve 22.

Actuation of the directional valve 18 to the right or left from the neutral position shown in FIG. 1 energizes the hydraulic circuit 15 to supply fluid either to the head end of actuator 6 or to the head end of actuator 6′. When valve 18 is actuated to the right in FIG. 1, fluid is supplied to the head end of actuator 6 and to the rod end of actuator 6' resulting in clockwise swinging movement of the swing bracket 2 (illustrated only by its axis). Conversely, actuation of valve 18 to the left in FIG. 1 causes fluid to be supplied from pump 16 to the head end of actuator 6' and rod end of actuator 6 which results in counterclockwise swinging movement of the swing bracket 2.

When fluid pressure is supplied to the head end of one of the actuators 6 or 6', the actuator is urged to extend by the head end fluid pressure. Conversely, when fluid pressure is supplied to the rod end of one of the actuators 6 or 6', the rod end fluid pressure urges the actuator to retract. However, when one of the actuators is in an overcenter position with respect to the axis of support member 4 so that its line of force is on the same side of support member 4 as that of the other actuator, the swing bracket 2 will prevent movement of the actuator in the direction urged by the fluid pressure acting on the actuator until the actuator moves from the overcenter position to the opposite side of the swing axis, i.e. the axis of the swing bracket support member 4.

A cross line 30 extends between lines 23 and 23', and lines 26 and 26' are connected with the cross line 30 through drain lines 27 and 27'. Lines 24 and 24' are connected with the cross line 30 through head end drain line 28. Line 26 is connected with lines 20' and 24' through line 23' by interconnecting line 32' bypassing line 27' and controlled by a check valve 34'. Similarly, line 26' is connected with lines 20 and 24 through line 23 by interconnecting line 32 controlled by a check valve 34 and bypassing line 27. A first exhaust check valve 36 is located in line 30 between its connection with line 23 and its connection with line 27. Similarly, a second exhaust check valve 36' is located in line 30' between its connection with line 27' and its connection with line 23'.

The flow to the head end of actuator 6 through line 24 is controlled by a normally open pressure reducing metering valve 38 which limits the pressure in line 24 to a predetermined maximum by closing to shut off flow to line 24 from line 23 when the predetermined maximum pressure exists in line 24. The pressure reducing metering valve 38 is controlled by a pilot pressure in a pilot line 40 connected with line 24 so as to sense the pressure at the head end of actuator 6. When line 20 is connected with the supply line 17, the pressure reducing metering valve 38 begins to meter the flow to line 24 when the pressure approaches a predetermined maximum, and shuts off the flow to line 24 when the pressure, as sensed through the pilot line 40, exceeds the predetermined maximum pressure. A similar pressure reducing metering valve 38' controls the pressure of hydraulic fluid to the head end of actuator 6' through line 24'.

Line 26 is controlled by a normally closed rod end metering valve 42'. Valve 42' is connected through a pilot line 44' with line 26, and through a pilot line 46' with line 20. If the pressure in the pilot lines 44' or 46' reaches a predetermined value to overcome the spring force biasing valve 42 to its closed position, valve 42 will begin to open and permit flow from the rod end of actuator 6 through lines 26 and 27' to line 30.

Line 28 is controlled by the pressure reducing metering valve 38 which has a metering as well as a pressure reducing function and has the pilot line 40 also connected with the metering function. When a predetermined pressure is reached in pilot line 40 the valve 38 overcomes the spring force biasing it to close its port to line 28 and begins to open permitting flow through line 28 from valve 38 to line 60 from line 24.

Flow through valve 38 from line 23 to line 24 occurs at a lower pressure than when flow is being forced from the head end of actuator 6 into line 28 from line 24. When flow is from line 24 to line 28 the port of valve 38 connected to line 23 is blocked off.

Similarly metering valve 42 and pressure reducing metering valve 38' control line 26' and line 28 in conjunction with line 24', respectively.

A normal operating cycle for the hydraulic system 15 when swinging the swing mechanism is described in the second parent application and will not be repeated herein.

Returning to the relocation of the check valves 22 and 22', it was found that locating the valves 22 and 22' below the cross line 30 rather than between the cross line 30 and interconnecting line 32 resulted in preventing flow from line 27 passing across check 36 into line 20 and across the directional valve 18 which has therefore become a single acting or one way valve.

Further, under conditions where the metering valve 42 is functioning and fluid is passing through line 27 to cross line 30 it is advantageous to use whatever portion of the flow may be needed to the head end of the actuator 6 such as when it crosses over center (point 4) or under conditions where the load overrides the actuator 6. Under these circumstances it is preferred to have the fluid travel through cross line 30 and supply line 23 across normally open pressure reducing metering valve 38 through line 24 into the head end of actuator 6.

It will be recognized that there is an alternative flow path through line 30 to sump 19 which is necessary to return the balance of the fluid to sump 19. A preference to have fluid flow to the head end of actuator 6 is maintained by sizing the line to sump 19 smaller than the line 23. The above preference in flow is enhanced by the increase in flow resulting from the check valve 22 preventing flow across the directional valve 18.

The opposite hand function occurs for metering valve 42' and line 27'.

The system of this invention provides improved control for most conditions where the actuators 6 and 6' would cavitate in the absence of the system providing fluid to the actuators 6 and 6'.

Another advantage is the system permits the use of a single acting directional valve over the double acting one required in previous embodiments.

While the invention has been described specifically in connection with backhoe swing apparatus, it is apparent that the invention is suitable for other uses, and particularly with other apparatus having a swinging boom. Therefore, terms and phrases, such as "backhoe" and "backhoe swing apparatus" as used herein, mean any such apparatus having a boom, or the like, that is normally hydraulically operated.

While a specific embodiment of the invention has been illustrated and described in the foregoing specification and accompanying drawings, it should be understood that the invention is not limited to the exact construction shown, but that various alterations in the construction and arrangements of parts is possible without departing from the scope and the spirit of the invention.

I claim:

1. In a control for a swing member mounted for side-to-side singing movement having a power source, sump and power means connected with the swing member for causing the swing member to swing in opposite directions in response to flow of fluid in opposite directions to and from respective ends of the power means including at least one pair of lines for conducting fluid to and from the power means; the swing member being responsive to flow of fluid to said power means in one of said lines to swing in one direction, and responsive to flow of fluid to the power means in the other of said lines to swing in the opposite direction; a pressure reducing metering valve controlling one of said lines, said pressure reducing metering valve being operable to limit pressure to the power means through said one line to a predetermined maximum pressure upon movement of the swing member in one direction, and to meter fluid from the power means through said one line upon movement of the swing member in opposition to fluid supplied to the power means; a metering valve operable to permit flow of fluid from said power means through said other line during the swinging movement of the swing member only when a predetermined minimum pressure exists in one of said lines; and a cross line extending between said one line and the sump; the improvement comprising: a check valve in said one line located between said cross line and the power source permitting flow to one end of said power means through said one line but preventing flow from the one end of said power means through said one line.

2. Apparatus as claimed in claim 1 including a directional valve between the power means and said check valve and a pilot line for said metering valve connected with said one line between said check valve and said directional valve.

3. Apparatus as claimed in claim 2 wherein said one line includes as a portion thereof a supply line containing said pressure reducing metering valve and a main line, said check valve connecting said main line to said supply line and said cross line connecting to said supply line.

* * * * *